US006174071B1

(12) United States Patent
Chan

(10) Patent No.: US 6,174,071 B1
(45) Date of Patent: Jan. 16, 2001

(54) FLASHLIGHT

(76) Inventor: Kwong Chi Chan, 7th Floor, Flat A, Manning Industrial Building, 118 How Ming Street, Kwun Tong, Kowloon (HK)

( * ) Notice: Under 35 U.S.C. 154(b), the term of this patent shall be extended for 0 days.

(21) Appl. No.: 09/299,918

(22) Filed: Apr. 28, 1999

(51) Int. Cl.[7] ..... F21L 7/00

(52) U.S. Cl. ..... 362/187; 362/280; 362/188; 362/293; 362/319; 362/322; 362/202; 362/208; 362/174; 362/167

(58) Field of Search ..... 362/280, 187, 362/188, 293, 319, 322, 202, 208, 174, 167

(56) References Cited

U.S. PATENT DOCUMENTS

| | | | | |
|---|---|---|---|---|
| 5,749,645 | | 5/1998 | Maglica | 362/205 |
| 5,765,937 | * | 6/1998 | Shiau | 362/187 |
| 5,816,688 | * | 10/1998 | Shui-Shang | 362/253 |
| 5,826,971 | * | 10/1998 | Kibler | 362/187 |
| 5,848,835 | * | 12/1998 | Cook | 362/208 |
| 5,865,525 | * | 2/1999 | Kibler et al. | 362/187 |
| 6,004,008 | * | 12/1999 | Lai | 362/280 |
| 6,082,876 | * | 7/2000 | Hanson et al. | 362/293 |
| 6,086,218 | * | 7/2000 | Robertson | 362/157 |

* cited by examiner

*Primary Examiner*—Sandra O'Shea
*Assistant Examiner*—Anabel M. Ton
(74) *Attorney, Agent, or Firm*—Leydig, Voit & Mayer, Ltd.

(57) ABSTRACT

A flashlight includes an elongate body having a front end and providing a compartment for containing a battery cell and a head assembly connected to the front end. The head assembly includes a light bulb, a reflector movable between an inner position behind the light bulb and an outer position surrounding the light bulb for light focusing, and a colored filter movable between an inner position behind the light bulb and an outer position surrounding the light bulb for light color changing. The flashlight includes a manually operated mechanism for initially moving the filter from the inner position to the outer position and subsequently moving the reflector from the inner position to the outer position.

20 Claims, 3 Drawing Sheets

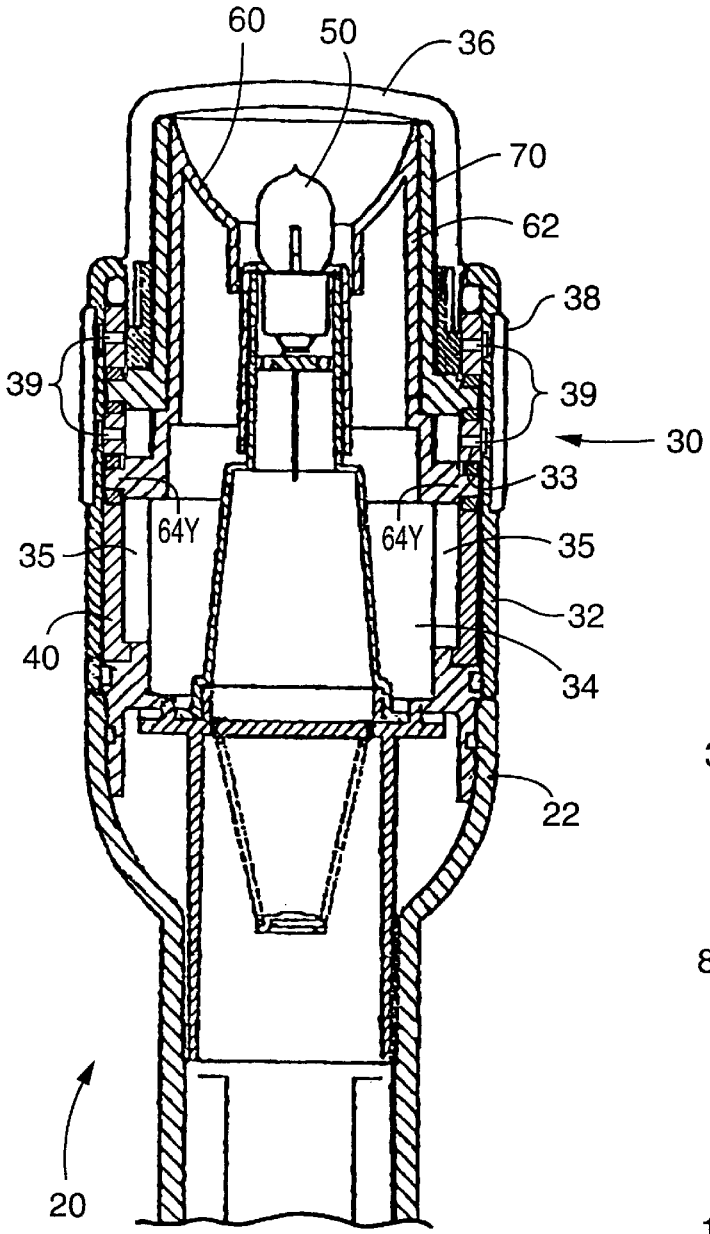
FIG. 2
FIG. 1
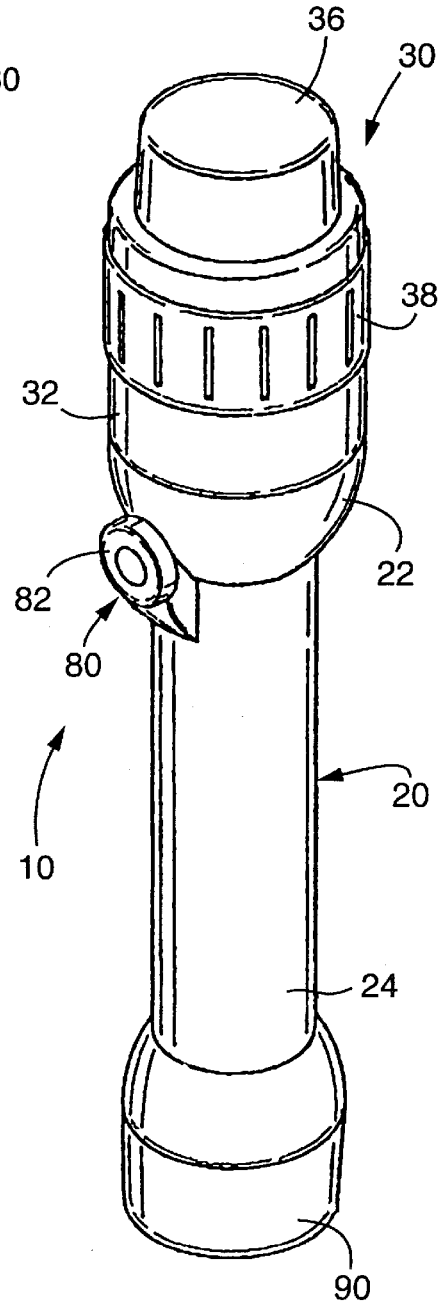

36
34
35
38
72/X
64/Y
46
80
20
50
30
44
32
Z
10
90

36
34
38
72/X
46
20
50
30
35
44
32
64/Y
80
Z
10
90

36
34
38
46
20
50
30
35
44
72/X
32
64/Y
80
Z
10
90

FLASHLIGHT

BACKGROUND OF THE INVENTION

It is known for a flashlight to have a reflector for light focus and a filter for changing the color of light. It is necessary for the reflector and filter to be movable for operation. As separate means are invariably required to move the reflector and filter, use is inconvenient.

The invention seeks to mitigate or to at least alleviate such a problem by providing an improved flashlight.

SUMMARY OF THE INVENTION

According to the invention, there is provided a flashlight comprising a elongate body having a longitudinal axis and a front end and providing a compartment for containing a battery cell; a head assembly connected to the body front end and comprising a light bulb, a reflector movable between an inner position behind the light bulb and an outer position surrounding the light bulb for light focusing, and a colored filter movable between an inner position behind the light bulb and an outer position surrounding the light bulb for light color changing; and a unitary manual operating mechanism for initially moving the filter from the inner to the outer position and subsequently moving the reflector from the inner to the outer position.

Preferably, the operating mechanism comprises a manual operating member on the head assembly, which is angularly movable about the axis of the body for operation.

More preferably, the operating member is in the form of a ring disposed around the head assembly.

In a preferred embodiment, the operating mechanism includes a cam provided between the operating member and the filter and reflector to enable the operating member to move the filter and reflector More preferably, the cam comprises a first cam track co-acting with the filter and a second cam track co-acting with the reflector.

Further more preferably, each of the first and second cam tracks has a transverse section and an inclined section towards the transverse section of the other cam track.

It is further preferred that the two transverse sections overlap with each other over a certain length, with their adjoining inclined sections extending apart in opposite directions.

In a preferred arrangement, the head assembly has an internal slot extending parallel to the axis of the body, and the filter and reflector have individual parts in sliding engagement with the respective cam tracks through the slot.

Preferably, the operating mechanism includes a pair of said cams provided on diametrically opposite sides of the axis of the body, with their respective cam tracks together extending substantially around the axis of the body.

It is preferred that the or each cam is substantially semi-cylindrical.

In a preferred embodiment, the head assembly includes a protruding cap lens, in which the light bulb, the reflector and the filter are provided.

BRIEF DESCRIPTION OF DRAWINGS

The invention will now be more particularly described, by way of example only, with reference to the accompanying drawings, in which:

FIG. 1 is a perspective view of an embodiment of a flashlight in accordance with the invention, the flashlight having a head assembly;

FIG. 2 is a cross-sectional side view of the head assembly of FIG. 1;

DETAILED DESCRIPTION OF PREFERRED EMBODIMENT

Figure 3:
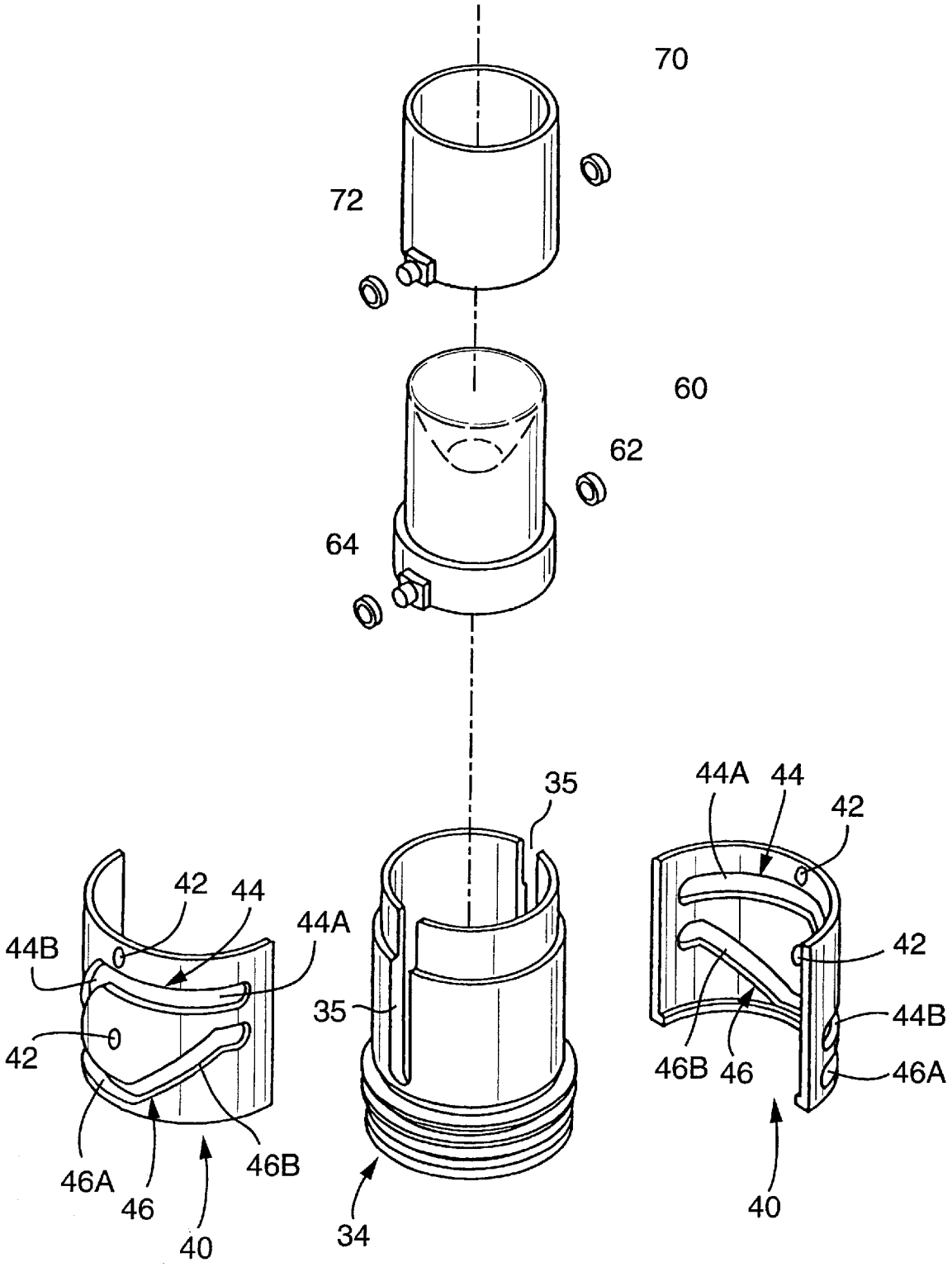
FIG. 3 is an exploded perspective view showing parts of the head assembly of FIG. 2.

Referring initially to FIGS. 1 to 3 of the drawings, there is shown a flashlight 10 embodying the invention, which comprises a plastic barrel 20 having open front and rear ends 22 and 24 and includes a plastic head assembly 30 and a plastic flat-bottomed tail cap 90 screwed co-axially to the front and rear barrel ends 22 and 24, respectively. The barrel 20 defines a compartment for containing, along its longitudinal axis, a series of battery cells. The head assembly 30 has a pair of co-axial cylindrical outer and inner bodies 32 and 34, a fixed cylindrical cap lens 36 closing and protruding from an open front end of the outer body 32, and a rotatable cylindrical ring 38 disposed on and around the outer body 32 for turning about the axis of the barrel 20, through an angle of about 160° in opposite directions.

A pair of semi-cylindrical cams 40 are slidably sandwiched between the outer and inner bodies 32 and 34, on diametrically opposite sides thereof, for turning by means of the ring 38. For turning the cams 40, the ring 38 is formed with two opposed pairs of inner pegs 39 which engage, through respective transversely extending slots of the outer body 32, respective holes 42 of the cams 40. Each cam 40 includes a pair of upper and lower cam tracks in the form of slots 44 and 46.

Each upper/lower cam slot 44/46 has a transverse section 44A/46A and an inclined section 44B/46B angled towards the transverse section 46A/44A of the other lower/upper cam slot 46/44. The two transverse sections 44A and 46A overlap with each other over a certain length across the middle part of the cam 40, with their adjoining inclined sections 44B and 46B extending in opposite directions. The inner body 34 includes a pair of diametrically opposite slots 35 extending parallel to the axis of the barrel 20, each of which intersects with the cam slots 44 and 46 of the respective cam 40 to define a pair of upper and lower cam holes X and Y.

Upon turning of the each cam 40 by means of the ring 38, the positions where the cam slots 44 and 46 intersect with the adjacent longitudinal slot 35 of the inner body 34 and, in turn the positions of the respective cam holes X and Y may change. For either cam slot 44/46, the cam hole X/Y will stay in the same axial position when the transverse section 44A/46A intersects the longitudinal slot 35. However, when the inclined section 44B/46B intersects the longitudinal slot 35, the cam hole X/Y will move downwards/upwards. As the two cams 40 are identical with and placed diametrically opposite to each other, the pair of cam holes X or Y will stay or move simultaneously, with the cam slots 44 and 46 together extending substantially around the axis of the barrel 20.

The head assembly 30 includes a stationary central light bulb 50 located within the cap lens 36 for energization by the battery cells contained in the barrel 20, a slidable reflector cup 60 disposed within the cap lens 36 and co-axially around the light bulb 50, and a slidable cylindrical orange-colored filter 70 disposed within the cap lens 36 and co-axially around the reflector cup 60. The filter 70 has a pair of diametrically opposite bottom side pegs 72 in engagement with the respective cam holes X. The reflector cup 62 has a cylindrical outer body 62 with a pair of diametrically opposite bottom side pegs 64 in engagement with the respective cam holes Y.

An on/off switch 80, incorporating a turning knob 82, is provided on the barrel 20 near the front barrel end 22. The switch 80 is electrically connected in series between the light bulb 50 and the battery cells for turning on and off the light bulb 50, in a conventional manner not forming part of the invention.

The light bulb 50 is positioned such that it extends out from the front end of the outer body 32 of the head assembly 30 for 360° illumination through the side wall of the cap lens 36. The reflector 60 is movable between an inner position behind the light bulb 50 and an outer position surrounding the light bulb 50 for light focusing. The filter 70 is movable between an inner position behind the light bulb 50 and an outer position surrounding the light bulb 50 for light color changing.

Figures 4A, 4B, 4C:
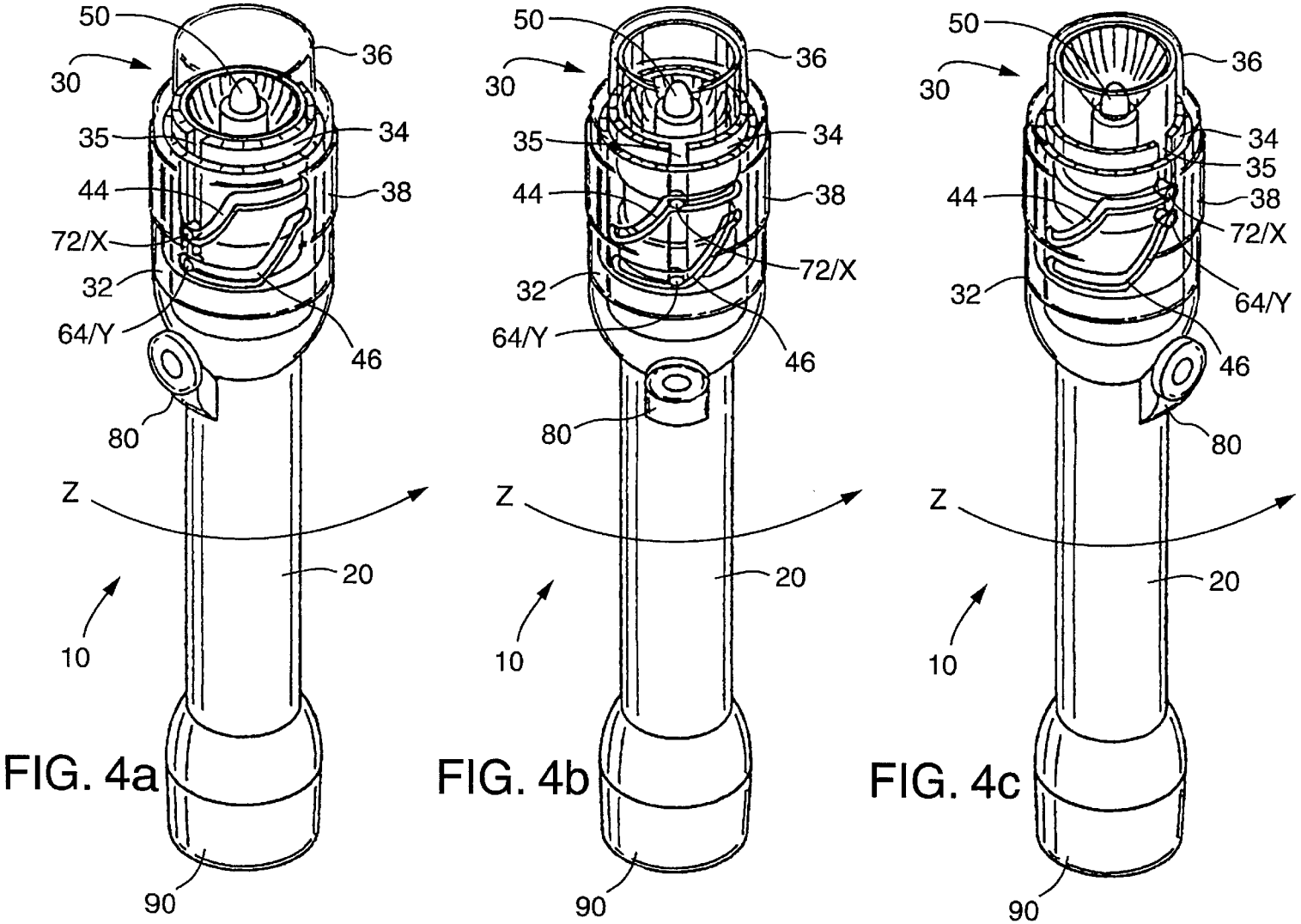
FIGS. 4A to 4C are perspective views showing the flashlight of FIG. 1 in sequential operating conditions.

In operation, the ring 38 is turned clockwise relative to the barrel 20 or, conveniently, the barrel 20 is turned anti-clockwise in direction Z relative to the ring 38, as shown in FIGS. 4A to 4C. Upon initial turning of the ring 38 from the relative position of FIG. 4A to that of FIG. 4B, the filter 70 will be moved upwards as a result of the aforesaid upward movement of the cam holes X, with the reflector 60 staying inside the outer body 32 of the head assembly 30. When the ring 38 is further turned from the relative position of FIG. 4B to that of FIG. 4C, the reflector 60 will subsequently be moved upwards by reason of the aforesaid upward movement of the cam holes Y, with the filter 70 staying extended from the outer body 32 of the head assembly 30. Reverse relative turning of the ring 38 (from FIGS. 4C to 4A) will cause retraction of the reflector 60 and subsequently retraction of the filter 70.

The ring 38 and the associated parts, including the cams 40, constitute a single operating mechanism for moving the reflector 60 and the filter 70, which is convenient and fun to use.

The condition of the flashlight 10 as shown FIG. 4A is suitable for general illumination like a candle, for example when the flashlight 10 is standing on the tail cap 90. In the condition of FIG. 4B, the flashlight 10 serves to provide a blinking rescue signal, under the control of a conventional electronic blinking circuit which is automatically enabled when the filter 70 is fully extended. As soon as the reflector 60 extends upwards, the blinking circuit is disabled, and the subsequent movement of the reflector 60 (from FIGS. 4B to 4C or vice versa) permit focusing of the light from the light bulb 50.

The invention has been given by way of example only, and various modifications of and/or alterations to the described embodiment may be made by persons skilled in the art without departing from the scope of the invention as specified in the appended claims.

What is claimed is:

1. A flashlight comprising:

an elongate body having a longitudinal axis and a front end and providing a compartment for containing a battery cell;

a head assembly connected to the front end and comprising a light bulb having a base and an envelope joined at a junction, light being emitted through the envelope, a reflector having a front end opening and a rear end opening smaller than the front end opening, for receiving the light bulbs the reflector being movable between an inner reflector position wherein the front end opening is substantially aligned with the junction of the base and the envelope of the light bulb and an outer reflector position wherein the rear end opening is substantially aligned with the junction of the base and the envelope of the light bulb for light focusing by the reflector, and a colored filter movable between an inner filter position wherein a front end of the colored filter is generally aligned with the junction of the base and the envelope of the light bulb and an outer filter position encircling the envelope of the light bulb for light color changing; and a manual operating mechanism for initially moving the filter from the inner filter position to the outer filter position and subsequently moving the reflector from the inner reflector position to the outer reflector position.

2. The flashlight as claimed in claim 1, wherein the operating mechanism comprises a manually operated member on the head assembly, angularly movable about the longitudinal axis of the body for operation.

3. The flashlight as claimed in claim 2, wherein the manually operated member includes a ring disposed around the head assembly.

4. The flashlight as claimed in claim 2, wherein the operating mechanism includes a cam located between the manually operated member and the colored filter and the reflector enabling the operating member to move the colored filter and the reflector.

5. A flashlight comprising:

an elongate body having a longitudinal axis and a front end and providing a compartment for containing a battery cell;

a head assembly connected to the front end and comprising a light bulb, a reflector movable between an inner reflector position behind the light bulb and an outer reflector position surrounding the light bulb for light focusing, and a colored filter movable between an inner filter position behind the light bulb and an outer filter position encircling the light bulb for light color changing; and a manual operating mechanism for initially moving the filter from the inner filter position to the outer filter position and subsequently moving the reflector from the inner reflector position to the outer reflector position, the manual operating mechanism comprising a manually operated member on the head assembly, annularly movable about the longitudinal axis of the body a cam located between the manually operated member and the colored filter and the reflector, enabling the manually operated member to move the colored filter and the reflector, and a first cam track co-acting with the colored filter and a second cam track co-acting with the reflector.

6. The flashlight as claimed in claim 5, wherein each of the first and second cam tracks has a transverse section and an inclined section extending towards the transverse section of the other of the cam tracks.

7. The flashlight as claimed in claim 6, wherein the two transverse sections overlap over a certain length, with their adjoining inclined sections extending in opposite directions.

8. The flashlight as claimed in claim 5, wherein the head assembly has an internal slot extending parallel to the longitudinal axis of the body, and the filter and the reflector have individual parts in sliding engagement with respective cam tracks through the slot.

9. The flashlight as claimed in claim 5, wherein the operating mechanism includes a pair of said cams provided on diametrically opposite sides of the longitudinal axis of the body, with respective cam tracks extending substantially around the longitudinal axis of the body.

10. The flashlight as claimed in claim 4, wherein the cam is substantially semi-cylindrical.

11. The flashlight as claimed in claim 1, wherein the head assembly includes a protruding cap lens in which the light bulb, the reflector, and the filter are located.

12. The flashlight as claimed in claim 5 wherein the cam is substantially semi-cylindrical.

13. The flashlight as claimed in claim 6 wherein the cam is substantially semi-cylindrical.

14. The flashlight as claimed in claim 5, wherein the manually operated member includes a ring disposed around the head assembly.

15. The flashlight as claimed in claim 5, wherein the head assembly includes a protruding cap lens in which the light bulb, the reflector, and the filter are located.

16. The flashlight as claimed in claim 4, wherein the cam comprises a first cam track co-acting with the filter and a second cam track co-acting with the reflector.

17. The flashlight as claimed in claim 16, wherein each of the first and second cam tracks has a transverse section and an inclined section extending towards the transverse section of the other cam track.

18. The flashlight as claimed in claim 17, wherein the transverse sections overlap over a certain length with their adjoining inclined sections extending in opposite directions.

19. The flashlight as claimed in claim 16, wherein the head assembly has an internal slot extending parallel to the axis of the body, and the filter and the reflector have individual parts in sliding engagement with the respective cam tracks through the slot.

20. The flashlight as claimed in claim 16, wherein the operating mechanism includes a pair of cams located on diametrically opposite sides of the axis of the body, with respective cam tracks extending substantially around the axis of the body.

* * * * *